United States Patent [19]

Johnson et al.

[11] Patent Number: 4,519,714

[45] Date of Patent: May 28, 1985

[54] WASTE MATERIAL AGITATOR

[75] Inventors: Warren K. Johnson, Alexandria; Michael R. Goettsch, Glenwood; Archie H. Olson, Alexandria, all of Minn.

[73] Assignee: Glenwood Manufacturing Corporation, Glenwood, Minn.

[21] Appl. No.: 617,114

[22] Filed: Jun. 4, 1984

[51] Int. Cl.[3] ..... B01F 7/06

[52] U.S. Cl. ..... 366/285; 366/308; 366/279

[58] Field of Search ..... 15/104.1 C; 74/96, 480 R, 74/495, 503; 134/166 C, 167 C, 168 C, 169 C; 366/64, 279, 264, 270, 285, 286, 308, 314, 325, 330, 331, 345, 349

[56] References Cited

U.S. PATENT DOCUMENTS

| | | | |
|---|---|---|---|
| 3,471,888 | 10/1969 | Grant et al. | 15/104.1 C |
| 4,358,298 | 11/1982 | Ratcliff | 366/286 |
| 4,431,597 | 2/1984 | Cramer et al. | 366/285 |
| 4,441,824 | 4/1984 | Brokaw | 366/319 |

*Primary Examiner*—Philip R. Coe
*Assistant Examiner*—Arthur D. Dahlberg
*Attorney, Agent, or Firm*—Kinney & Lange

[57] ABSTRACT

An apparatus for agitating a fluid that contains a sludge-like material which is stored in an enclosure, such as a pit, storage tank or pond, includes an elongated frame with a motor and a propeller pivotally mounted within a guard at a lower end of the frame, a linkage assembly attached at one end to the motor and the propeller, and a handle pivotally mounted at an upper end of the frame and connected to the other end of the linkage assembly. The motor and propeller are pivotally mounted so that the propeller is pivotable in a generally vertical direction between a first position, generally along the axis of the frame, and a second upward position, angularly displaced from the first position, for directing the agitation caused by the propeller. In addition, the motor and propeller are mounted within the guard so that the propeller is prevented from hitting the floor of the enclosure when the apparatus is rotated about its longitudinal axis.

10 Claims, 5 Drawing Figures

WASTE MATERIAL AGITATOR

BACKGROUND OF THE INVENTION

1. Field of the Invention

The present invention relates to apparatus for agitating a fluid containing a sludge-like material, such as liquid manure, and in particular, it relates to portable agitators for agitating the sludge-like material into a slurry.

2. Description of the Prior Art

The storing of liquid manure in feed lot, hog and dairy operations has become relatively common. The manure is generally collected in either a concrete pit located outside or underneath a building, or in an earthen-type pond. The manure is stored for either later use on fields or to be hauled away and disposed of otherwise.

The manure is substantially in a fluid form that contains solids that eventually settle out onto the bottom of the pit or enclosure. In order to remove the manure from the pit or enclosure in an efficient and easy manner, the liquid portion of the manure and the solids are agitated to form a slurry. The slurry can then be easily pumped out, removing both liquid and solid matter, from the pit or enclosure.

The Graham U.S. Pat. No. 4,329,069 illustrates the use of a device that is inserted through a section of piping into a pit containing a liquid manure so as to mix the solids and the liquid to form a slurry. A hydraulic motor is positioned near the top of the tube and has a relatively long drive shaft extending down the tube with blades positioned along the drive shaft. The arrangement in the Graham Patent has the disadvantage that debris could become entangled within the tube along the blades. Moreover, the long drive shaft of Graham is apt to vibrate in use.

The Bellows et al U.S. Pat. No. 3,168,255 illustrates a liquid manure agitator having a propeller attached at the end of a long shaft that extends into the manure pit. In using the agitator of the Bellows Patent, there is the danger that the propeller can be damaged by hitting against the sides or the floor of the pit. Moreover, it is very hard to hold the agitator in a desired position.

The Conover U.S. Pat. No. 3,235,232 shows an agitator that is placed vertically into a pit. The agitator has a motor up at the top of the unit and a long drive shaft with two sets of propeller blades positioned in a tube. The device of the Conover Patent is designed for use in a drainage-type ditch where fluid flows past the agitator and is not particularly suited for use in a still-type pond or pit where the agitation needs to be directed in order to form a suitable slurry.

The Stencil Manufacturing Company of Denmark, Wis., markets a liquid manure agitator under the mark "THE SLUDGE MOVER I". The Stencil Manufacturing device includes a long shaft with a pivotally-attached lower portion on which the hydraulic motor and propeller are attached. The device is suspended from a draw bar on the tractor. A linkage assembly is included that is operable from the end of the shaft extending out of the pit so that the agitation can be directed within the pit. However, the propeller is movable to direct the agitation of the manure only along a plane of the shaft of the device.

SUMMARY OF THE INVENTION

The present invention includes an apparatus for agitating a fluid that contains a sludge-like material, such as liquid manure, which is stored in an enclosure, such as a concrete pit or pond. The apparatus includes an elongated frame having an upper end that extends out of the liquid manure and a lower end which rests on the floor of the pit or pond. A motor and propeller are pivotally attached to the frame at a lower end such that the propeller is spaced from the lower end of the frame. A linkage assembly extends along the frame and is attached at one end to the motor and is attached at an upper end to handle such that when the handle is moved, the propeller is positionable in a generally vertical direction between a first downwardly-facing position along the axis of the frame and a second upwardly-facing position angularly spaced from the first position so that the propeller can be directed to agitate manure in any position therebetween and is always spaced from the floor, to avoid hitting the floor.

DETAILED DESCRIPTION OF THE PREFERRED EMBODIMENTS

Figure 1:
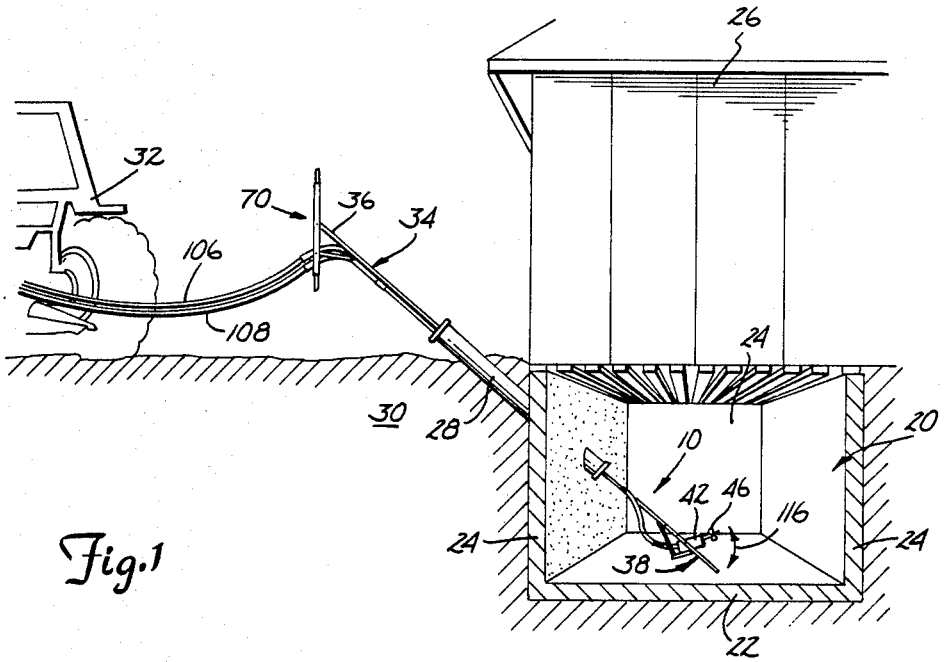
FIG. 1 is an elevational view of the apparatus of the present invention shown in use in a manure pit, the pit being shown in section.

The apparatus of the present invention is generally indicated at 10 in FIG. 1. The apparatus 10 is preferably used as a manure agitator for agitating liquid manure stored in an enclosure, such as a concrete pit 20, having a floor 22 and side walls 24. The pit 20, as illustrated in FIG. 1, is located below an animal shelter 26 containing farm animals, such as cows or hogs. Although a pit is specifically shown, often times manure is also stored in a earthen containment pond. The manure agitator 10 is also ideally suited for agitating manure in earthen containment ponds.

Access to the pit 20 is provided by an inlet pipe 28 that extends through one of the walls 24 of the pit, through the ground 30 and to a position above the ground. A typical inlet pipe has an eight inch (8″) diameter, such pits are commonly provided with such inlet pipes.

One suitable method of powering the manure agitator of the present invention is to power the apparatus from the hydraulic system (not shown) of a tractor 32. The tractor's hydraulic system (not shown) provides a versatile and economical method of running the manure agitator.

Figure 2:
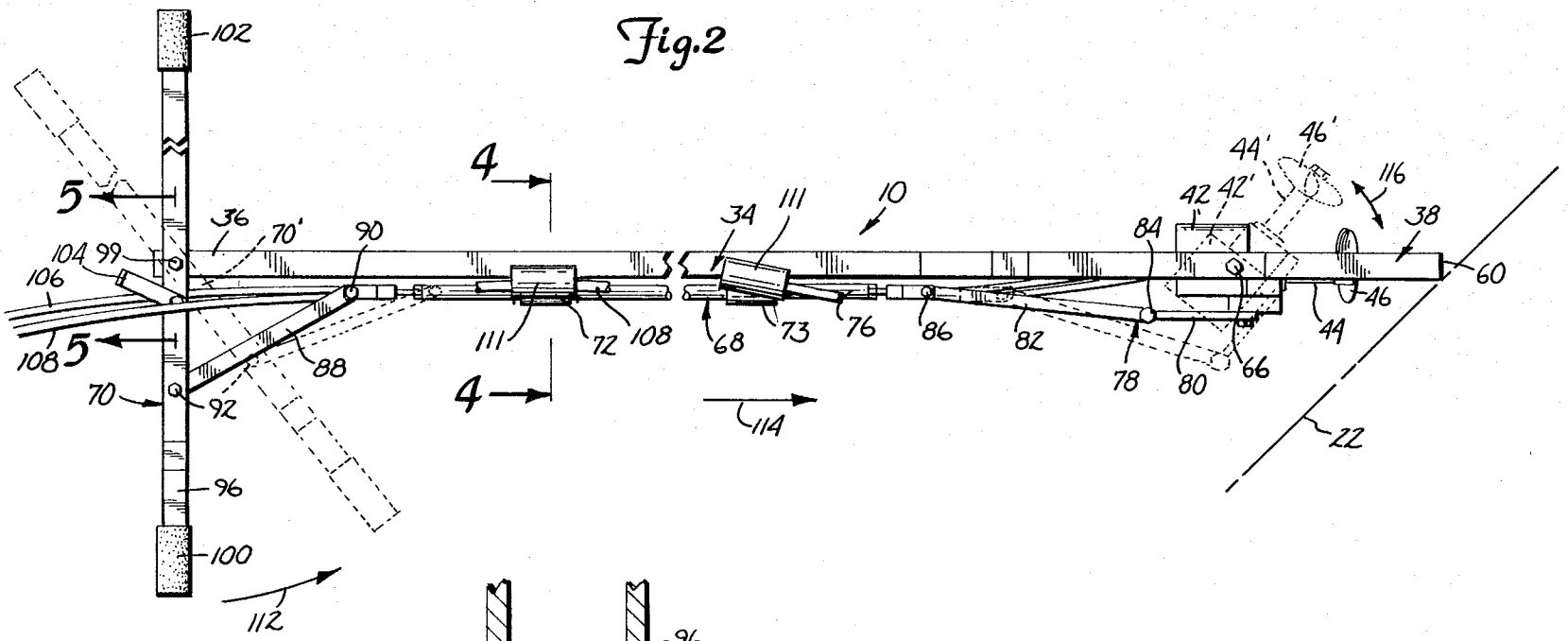
FIG. 2 is a side view of the apparatus.

Referring to FIG. 2, the agitator 10 includes a relatively long main frame 34 having an upper end portion 36 that extends out of the manure pit and a lower guard floor-engaging end portion 38. In one working embodiment, the length of the main frame is greater than thirteen feet (13′) allowing the agitator to be positioned well down into the pit so as to rest on the floor and with the upper end extending sufficiently above the ground for convenient operation.

Figure 3:
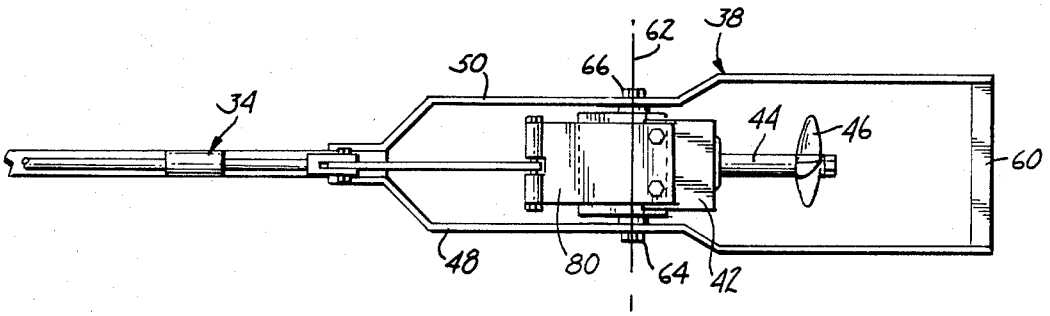
FIG. 3 is an enlarged top view of the end portion of the apparatus.

A motor 42, a shaft 44 and a propeller 46 are pivotally mounted on the lower floor-engaging end portion 38 of the main frame 34. As illustrated in FIG. 3, the floor-engaging end portion 38, preferably, has first and second spaced-apart rigid support bars 48 and 50, respectively, that are spaced apart sufficiently so that the motor 42, shaft 44 and propeller 46 are positioned therebetween. The motor 42 is pivotally attached to the bars 48 and 50 along an axis 62 with a pair of suitable bolts 64 and 66 for pivotal movement in a generally vertical direction. An end bar 60 is fixedly attached to the lower ends of the first and second bars and extends therebetween to form a floor-engaging end. As is easily understood from FIG. 3, the bars 48, 50 and end bar 60 form a protective enclosure for the propeller 46 protecting the propeller 46 from hitting the floor or from hitting any side walls when the apparatus is moved about.

A linkage assembly 68 extends along the frame 34 and is attached at a lower end to the motor 42 and is attached at an upper end to a control member, such as a handle 70. Guides 72 and 73 are used to hold the linkage assembly along the frame 34.

Figure 4:
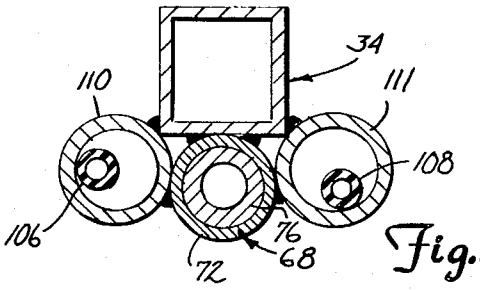
FIG. 4 is an enlarged cross sectional view of the frame structure taken along the line 4—4 in FIG. 2.

The linkage assembly 68 includes a rigid middle member 76 which slidably engages the guides 72 and 73, as best illustrated in FIGS. 2 and 4. The member 76 is attached at a lower end to a linkage subassembly 78. The subassembly 78 includes a rigid plate 80 bolted to the motor 42 so that the plate 80 lies in a plane substantially parallel to the axis of rotation of the propeller 46. A rigid connecting member 82 is pivotally attached to the plate 80 by a pivot pin 84 and is pivotally attached to the lower end of the member 76 by a pivot pin 86.

The member 76 at an upper end is attached to the handle 70 by an upper rigid connecting member 88. The member 88 is pivotally attached at a lower end by a pivot pin 90 to the member 76 and pivotally attached at an upper end by a pivot pin 92 to the handle 70.

Figure 5:
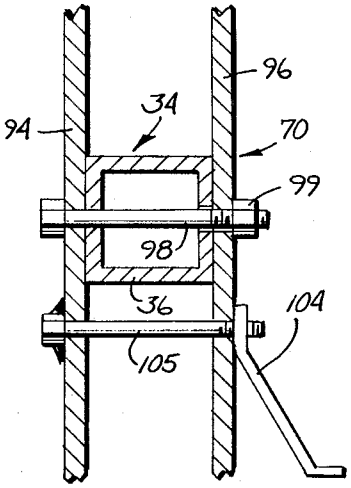
FIG. 5 is an enlarged cross sectional view of the handle taken along the line 5—5 in FIG. 2.

The handle 70 preferably includes a left rigid bar 94 and a right rigid bar 96 spaced from the left rigid bar with the frame 34 positioned therebetween, as best illustrated in FIG. 5. The bars 94 and 96 are pivotally attached to the frame member 34 by a suitable bolt 98 and nut 99. The left and right rigid bars 94 and 96 converge towards each other at their ends and are welded to each other and are covered by suitable handle grips 100 and 102, as illustrated in FIG. 2. The handle grips 100 and 102 may be made of any suitable material, such as natural or synthetic rubber.

A bolt 105 and a bar 104 acts as a tightener. The bolt 105 and 104 extend through the bars 94 and 96. The bolt 105 is welded to the bar 94 and threadably engages the bar 104. The handle member is pivoted to a selected position and the bar 104 is turned, tightening the bars 94 and 96 against the frame 36 sufficiently so that the handle member is secured in the selected position.

Preferably, the motor 42 is a hydraulic motor which is supplied hydraulic fluid through hydraulic lines 106 and 108 from a suitable hydraulic source such as the hydraulic system (not shown) of the tractor 32, as illustrated in FIG. 1. The hydraulic lines 106 and 108 are attached to the longitudinal frame member 34 by two pair of suitable guides 110, 111 attached to the frame 34, as illustrated in FIGS. 2 and 4. Although a hydraulic motor 42 is shown, alternative motors, such as motors that can be powered from the power take-off of the tractor 32 or from an electrical outlet, are within the scope of the present invention.

In use, the apparatus 10 of the present invention is placed into a pit or a pond by resting the floor-engaging end portion 38 against the floor of the pit or pond, as illustrated in FIG. 1. To position the apparatus 10 in an enclosed pit having the inlet pipe 28, the apparatus is inserted into the pipe with the motor 42, shaft 44 and propeller 46 in a first position wherein the rotational axis of the propeller 46 is substantially parallel to the longitudinal axis of the frame 34 so that the apparatus can be easily inserted through the inlet pipe 28. The hydraulic lines 106 and 108 are connected to the hydraulic system (not shown) of the tractor 32 and the motor 42 of the apparatus is turned on by starting the hydraulic system (not shown).

The propeller 46 is pivotable in a generally vertical direction approximately 90° from the first position to a second position, as indicated by broken lines 46. The propeller 46 can be positioned at any point between the first and second position to direct the agitation produced by the movement of the propeller to various areas within the pit so that the settled solid matter can be combined with the liquid to form a slurry suitable for pumping out of the pit. In order to move the propeller to the second position from the first position or any position between the first and second position, the handle is moved in a direction of arrow 112, as illustrated in FIG. 2. When the handle is moved, as indicated by broken lines 70' the member 76 slides through the guides 72 and 73 downwardly along the frame in the direction of arrow 114. The downward action of the member 76 acts on the linkage subassembly 78 so that the motor pivots about bolts 64 and 66 thereby moving the propeller 46 along one direction of arrow 116, as indicated by broken lines 42', 44' and 46'. The angular displacement of the propeller is limited to an approximate 90° displacement by the backside of the motor engaging the member 82 and acting as a stop.

In most concrete pits, similar to the one illustrated in FIG. 1, the steepest angle that the inlet tube 28 is disposed with respect to the floor is approximately 60°. The apparatus 10, when positioned in the tube 28, can be rotated in the tube in any direction without the propeller contacting the floor. The propeller 46 is positioned a distance from the end bar 60 such that its arcuate path of travel at inclines of approximately 45° or greater does not come into contact with the floor even if the apparatus is rotated 180° from the position illustrated in FIG. 1 such that the propeller 46 is disposed in an opposite direction.

The apparatus 10 is rotatable about its longitudinal axis within the tube by holding the handle or the upper end portion 36 of the frame and rotating the apparatus. The agitation is thereby directed to reach desired areas of the pit by either standing the apparatus on a left or right side end portion of the floor-engaging end portion 38 or rotating the frame 180° from the position illustrated in FIG. 1. During rotationg of the apparatus, the support bars 48 and 50 prevent the propeller 46 from hitting the floor.

The shaft 44 rotatably connecting the propeller 46 to the motor 42 is relatively short since the motor and propeller are mounted within the floor-engaging portion 38. The short shaft 44 eliminates much of the vibration and wobble during agitation found in prior art devices and increases propeller speed and discharge rate.

Although the present invention has been described with reference to preferred embodiments, workers skilled in the art will recognize that changes may be made in form and detail without departing from the spirit and scope of the invention.

What is claimed is:

1. An apparatus for agitating a fluid containing a sludge-like material stored in an enclosure having a floor and side walls, the apparatus comprising:

an elongated frame having a longitudinal axis and a lower floor-engaging guard portion defining an enclosure and an upper end portion;

means for agitating the fluid containing the sludge-like material pivotally attached to the frame within the guard portion;

pivotal mounting means for mounting the means for agitating such that the means for agitating is positionable in a generally vertical direction between a first position substantially along the longitudinal axis of the elongated frame and a second upward position angularly spaced from the first position; and control means for controlling the pivotal movement of the means for agitating attached to the frame and including a control mechanism situated proximate the upper end portion of the frame and a linkage assembly extending along the elongated frame and pivotally connected to the control mechanism at one end and pivotally attached to the agitating means at another other end so that the agitating means is positionable between the first and second position through manipulation of the control mechanism.

2. The apparatus of claim 1 wherein the floor-engaging guard portion includes first and second spaced-apart rigid members extending substantially in the direction of the axis of the frame and a third cross member attached to and extending between the first and second rigid members and spaced from the propeller, protecting the propeller from engaging the floor.

3. The apparatus of claim 1 wherein the means for agitating includes a motor pivotally mounted within the guard portion and a propeller rotatably attached to the motor and positioned within the guard portion when in the first position.

4. The apparatus of claim 3 wherein the motor is a hydraulic motor.

5. The apparatus of claim 1 and further including means for limiting the pivotal movement of the means for agitating to approximately 90° from the first position.

6. The apparatus of claim 1 wherein the control mechanism includes a handle.

7. The apparatus of claim 6 wherein the linkage assembly includes a middle rigid member and guide means attached to the frame, the middle rigid member being in sliding cooperation with the guide means and a first connecting member pivotally connected to the handle at one end and pivotally connected to the middle rigid member at another end and a linkage subassembly pivotally connected to the middle rigid member at one end and rigidly attached to the means for agitating at another end.

8. The apparatus of claim 7 wherein the linkage subassembly includes a second rigid connecting member and a third rigid connecting member, the second rigid connecting member being pivotally connected to the middle rigid member at one end and pivotally connected to the third rigid member at another end and the third rigid member being fixedly attached to the means for agitating.

9. The apparatus of claim 7 wherein the handle is pivotally attached to the upper end of the frame.

10. The apparatus of claim 1 wherein the means for agitating is disposed within the guard portion such that the means for agitating does not engage the floor during rotation of the apparatus about its longitudinal axis when the longitudinal axis of the apparatus is disposed at angles of approximately 45° or greater with respect to the floor.

* * * * *